US008317420B2

(12) United States Patent
White

(10) Patent No.: US 8,317,420 B2
(45) Date of Patent: Nov. 27, 2012

(54) RIBBON CASSETTE

(75) Inventor: Dennis R White, Yorba Linda, CA (US)

(73) Assignee: Printronix, Inc., Irvine, CA (US)

( * ) Notice: Subject to any disclaimer, the term of this patent is extended or adjusted under 35 U.S.C. 154(b) by 595 days.

(21) Appl. No.: 12/562,489

(22) Filed: Sep. 18, 2009

(65) Prior Publication Data

US 2011/0070011 A1 Mar. 24, 2011

(51) Int. Cl.
*B41J 32/02* (2006.01)

(52) U.S. Cl. ..... 400/196; 400/196.1; 400/248; 400/208

(58) Field of Classification Search ..... 400/194–196.1, 400/247, 248, 208; *B41J 32/02*
See application file for complete search history.

(56) References Cited

U.S. PATENT DOCUMENTS 3,993,233 A 11/1976 Bartell
4,130,367 A 12/1978 Guerrini et al.
4,408,910 A * 10/1983 Masao ..... 400/207
4,783,184 A * 11/1988 Santillo et al. ..... 400/196.1
4,828,411 A 5/1989 Oba

FOREIGN PATENT DOCUMENTS

JP 62013376 A * 1/1987
JP 02238982 A * 9/1990

* cited by examiner

*Primary Examiner* — Leslie J Evanisko
(74) *Attorney, Agent, or Firm* — Haynes and Boone, LLP

(57) ABSTRACT

In one embodiment, a ribbon cassette includes two rows of spherical bumps extending between sidewalls of the cassette on both a floor and ceiling of the cassette and a pair of concentric arched retaining walls on both the floor and ceiling between an exit gate and the rows of bumps. In another embodiment, there is only one row of bumps and one retaining wall on the floor and ceiling. In another embodiment, the retaining walls are straight. The two rows and retaining walls, along with cassette sidewalls, form three distinct zones for densely packing the ribbon, unpacking the ribbon, and isolating the ribbon, resulting in less jamming with longer lengths of ribbon.

15 Claims, 6 Drawing Sheets

RIBBON CASSETTE

BACKGROUND

1. Field of the Invention

The present invention generally ribbon cassettes.

2. Related Art

Impact printing is a well-established art that grew out of the typewriter industry, which was adapted to accommodate the advent and development of computer technology. As such, the basic printing technique has remained the same: an ink-impregnated ribbon is juxtaposed between printable media (paper, film, card stock, etc.) and an impact hammer. The media is positioned against a platen so that when the hammer strikes the ribbon, ink is transferred from the ribbon into the media, producing an ink mark on the media. As the speed of printing has increased, so has the need for greater ink capacity and durability in the supply ribbon. This demand has been addressed in a variety of ways, including employing a longer and/or wider ribbon web, improving the durability of the ribbon, improving the quality of the ink, and increasing the volume of ink available by re-inking the ribbon web from a reservoir of ink.

There have been two basic techniques developed for storing and delivering the ribbon web to the printing station in the printer. The first method employed was, and continues to be, to store the length of ribbon within two spools. As printing occurs, the ribbon spools reciprocally rotate, continuously transferring the ribbon back-and-forth between the two spools. As the ribbon dwells on one or the other spool, ink diffuses from the more concentrated areas on the ribbon web to those areas where ink was transferred off of the ribbon through the printing action. However, due to high ink viscosity and relatively low ink volume, transfer through diffusion is slow and limited such that for anything other than evenly distributed printing patterns, as the inked ribbon approaches mid-life, noticeable variations of print density can appear in the printed media due to ink concentration gradients in the supply ribbon.

The second method of storing and delivering inked ribbon to the printing station significantly improves on the shortcomings of the first technique. This second method can be referred to as a ribbon cassette and can be described basically as a box within which inked ribbon—in the form of a mobius loop—is stored, and delivered to the print station by continuously pulling the ribbon in one direction through a series of rollers and guides. Because of the mobius half-twist, even with uneven printing patterns, ink tends to be more evenly transferred out of the ribbon over the life of the ribbon cassette.

However, typically, designs have inherent limitations and disadvantages, and the mobius cassette is no exception. Some of the disadvantages inherent in cassette designs include: 1) ribbon tracking problems (where the ribbon drifts laterally out of alignment) due to tension variation across the width of the ribbon, 2) ribbon edge damage due either to abrasion against wearing plastic surfaces or to impacts from printing hammers in the event that ribbon tracking errors bring the edge too close to the printing zone, and 3) ribbon jamming problems where the ribbon becomes wedged into confined spaces in the cassette resulting in excessive ribbon tension such that the drive mechanism cannot free the wedged ribbon.

Typically a motor is employed to drive the ribbon motion. To the motor shaft is attached a plastic gear or pinch roller, either of which is operated against a counter-rotating gear or roller (which is radially loaded against the drive roller), such that the ribbon, which is threaded in between the two, is forcibly pulled from the printing mechanism area into a holding volume or "stuff-box" within the cassette housing. At the far end of the stuff-box area is arranged a narrow gate through which the exiting ribbon loop continues to flow as an isolated, individual web. Passing through the gate, the ribbon is then guided over two triangular walls positioned parallel to each other and separated by a horizontally oriented gate so that the ribbon web is flipped through a mobius twist as it passes over the edges of these features. Once half-twisted in this fashion, the ribbon passes through a pinch-point (usually comprised of a leaf spring flexed against a vertical rib edge in the cassette housing), which provides sufficient back-tension in the ribbon web so as to ensure accurate translation through the print station. The ribbon web continues through the print station and back into the cassette entrance point, thus completing the loop.

The nature of the ribbon configuration in the stuff-box area is one of randomly oriented stacks of contiguous ribbon segments, folded back-and-forth in "S" like patterns, and connected "head-to-tail" by somewhat straighter segments of ribbon. Both the orientation and length of these stacked patterns are random, such that as the ribbon exits the stuff-box area, a great many differences in tension, approach angle, and friction from adjacent ribbon folds occur in that exiting segment. In the absence of any obstacles between the stuff-box area and the exiting gate, these serpentine segments of ribbon would become pressed up against the exit gate and would be dragged into the gate by the exiting web, thereby causing the ribbon to jam. This phenomenon of ribbon dynamics as the ribbon web exits a stuff-box through a narrow isolation gate, makes the task of isolating the single exiting web from the rest of the stack rather problematic. It is therefore necessary to design structural obstacles, such as ribs in the ceiling and floor and converging sidewalls so as to retard the advance of the stuffed ribbon, allowing only the exiting segment to advance to the exit gate. These approaches (ribs and converging sidewalls) are well known in the art.

Intuitively, the features designed to retard the ribbon stack from entering the gate may be more or less effective in preventing jams. A given design may be adequate under certain conditions, but become less effective under different conditions. Experience shows that one condition limiting the effectiveness of these jam-prevention features is the density of the ribbon (i.e. the amount or length) packed into the stuff box area. There is a natural limit as to the amount of ribbon that can be stuffed into a given cassette, due to the amount of pressure that the ribbon "pack" applies to the leading boundary of ribbon as it exits the stuff-box area. Once this limit is reached, a jam in the exit gate area becomes highly probable because as the density of the ribbon pack increases, more and more energy is stored in the ribbon folds—much like a compression spring. At the exit gate area, as local stacks of ribbon are removed from the pack, more and more energy is stored in the remaining local stacks, so that when they in turn become released, they spring forward rapidly. This increase in velocity and density of ribbon folds in the vicinity of the ribbon retarding features can result in multiple folds getting past those features and entering the gate thus causing a jam.

In the past, there have been numerous efforts to mitigate the propensity for jamming in the exit gate, including one or more shallow walls or ribs protruding up from the floor and down from the cover. The function of the rib (or ribs) so oriented is to block the advance of the packed ribbon mass, while allowing the single exiting web to advance by forcing it to buckle so it can pass by the ribs.

Other ideas include the positioning of angled side walls, and schemes for laying-down the folding ribbon in more uniform patterns (e.g., as disclosed in U.S. Pat. Nos. 4,645, 364; 4,645,388; and 4,212,420). Uniform ribbon packing schemes are inherently problematic and unreliable, and tend to add excessive cost to the manufacture of such cartridges.

FIG. 1 illustrates some of the physical characteristics of ribbon packing and translation through an exit gate of a conventional ribbon cassette. As can be seen in the illustration, packing forces transfer through the stuffed stack of ribbon, pressing the leading folds of ribbon against retaining walls or ribs 102 just "upstream" of an exit gate 104. As ribbon is extracted through gate 104, a void 106 forms in the stuff box area, leaving the remaining ribbon in contact with the retaining wall to carry all of the packing forces. The resulting increase in pressure on the leading folds of ribbon forces some of them past retaining ribs 102, which allows them to expand rapidly into the area immediately in front of exit gate 104. Occasionally, this pulse of motion in the expanding bundle of ribbon results in one or more folds advancing into the immediate vicinity of exit gate 104, potentially initiating a ribbon jam as the exiting web drags one of them into gate 104.

This condition is exacerbated by increasing the amount of ribbon in the stuff box area and is reduced by lowering the amount of ribbon stuffed into the cartridge. Since it is often desirable to maximize the amount of ribbon in the cartridge, an inexpensive means of preventing this mode of ribbon jamming while increasing the length of ribbon stored would be advantageous.

SUMMARY

In accordance with an embodiment of the invention, a ribbon cassette has spherical bumps along both the floor and ceiling of the cassette, with one or more retaining ribs extending from both the floor and ceiling between the spherical bumps and an exit gate of the cassette. In one embodiment, the cassette includes a first row of three bumps, which along with machine components used to stuff the ribbon into the cassette, form boundaries of a first zone. A second zone is formed between a second row of three bumps and the first row of bumps. A third zone is formed between the exit gate and the second row of bumps. Each zone is bounded also by the side walls of the cassette. In another embodiment, there is a single row of bumps, such that only two zones are formed.

In one embodiment, the bumps along the ceiling are approximately 0.125 inches tall and the bumps along the floor are approximately 0.110 inches tall, each having a diameter of approximately 0.52 inches. In one embodiment, the spherical bumps on the floor are aligned with those on the ceiling. In another embodiment, the bumps are staggered.

The first zone is a high density zone stuffed with ribbon. As the density increases, ribbon is forced over the spherical bumps to the second zone, temporarily decreasing the density in the first zone. Ribbon entering the second zone is stopped by the second row of spherical bumps. However, ribbon in the second zone is low density due to a limited amount of ribbon allowed through by the first row of bumps. As a result, tension in the ribbon web is nearly zero and contact or friction between adjacent segments of the ribbon is also nearly zero. Ribbon entering the third zone from the second zone, such as by being drawn out of the second zone, reaches the exit gate essentially unimpeded, resulting in low likelihoods of jamming.

In one embodiment, there are two retaining ribs formed as two concentric arches centered on the exit gate. When ribbon contacts the arched ribs, the folds are separated rather than pinched together, thereby allowing the two rows of bumps to be moved closer to the gate without increasing likelihoods of jamming. As a result, the volume of the first zone can be increased, which enables more ribbon to be housed in the cassette.

Thus, the ribbon cassette mitigates the described ribbon jamming mode by reducing the density of ribbon packing in the area just upstream of the retaining walls, while allowing an increase in density in the stuff box area further upstream. It does this by adding molded-in features in the cartridge housing and cover, thus avoiding increased costs to the cartridge assembly due to increased part count.

These and other features and advantages of the present invention will be more readily apparent from the detailed description of the embodiments set forth below taken in conjunction with the accompanying drawings.

Figure 1:
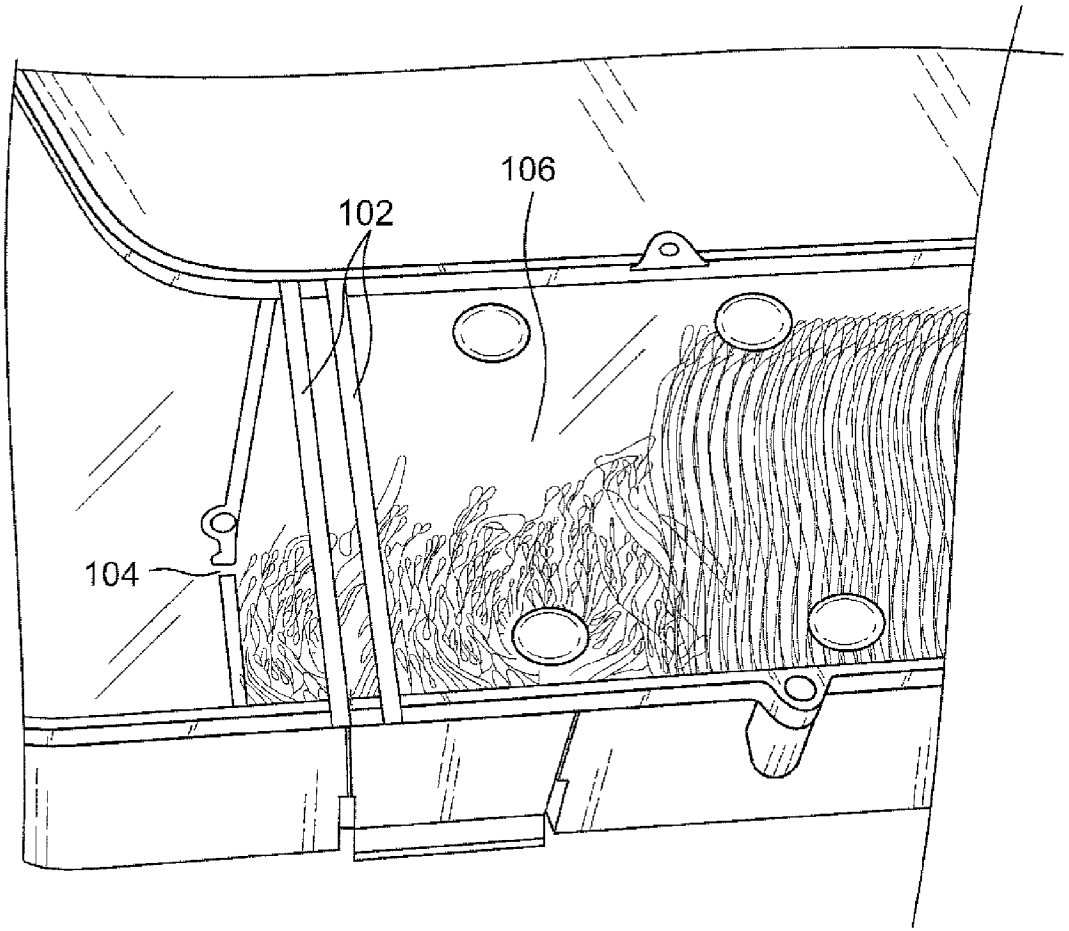
FIG. 1 PRIOR ART
FIG. 1 shows of a ribbon cassette that can be used with the features according to one embodiment.

Embodiments of the present disclosure and their advantages are best understood by referring to the detailed description that follows. It should be appreciated that like reference numerals are used to identify like elements illustrated in one or more of the figures, wherein showings therein are for purposes of illustrating embodiments of the present disclosure and not for purposes of limiting the same.

DETAILED DESCRIPTION

Figure 2:
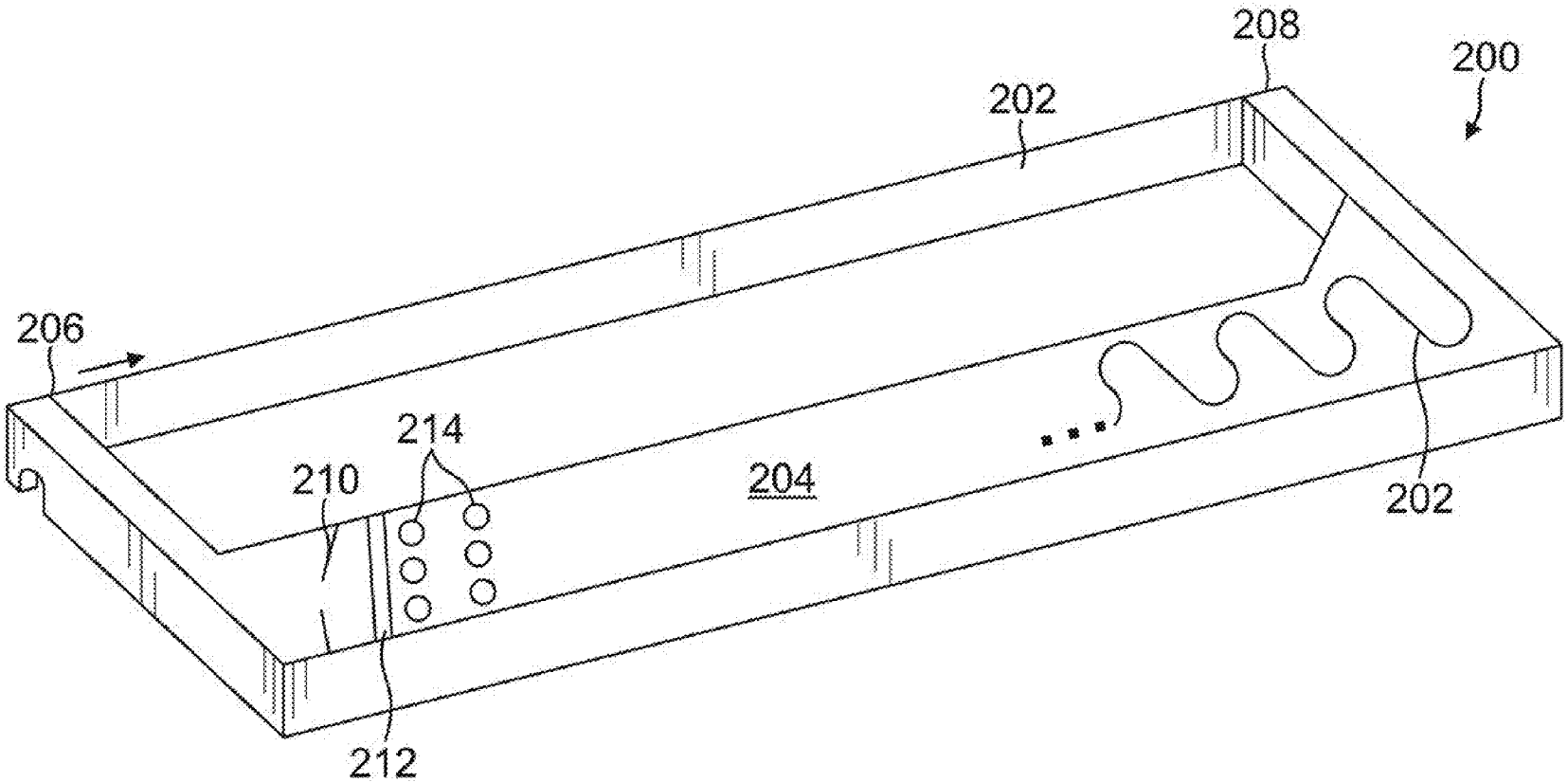
FIG. 2 is a general diagram of a ribbon cartridge according to one embodiment.

FIG. 2 shows a ribbon cassette 200 according to one embodiment of the present invention that can be used with different configurations of retaining walls and spherical bumps. Note that other types or shapes of ribbon cassette or cartridges may also be suitable. Ribbon cassette 200 holds a ribbon 202 within an enclosing space 204 in a central portion of the cassette. Most of ribbon 202 is folded within space 204. Ribbon 202 exits cassette 200 at an opening 206 and is pulled back into the cassette at opening 208. In between openings 206 and 208, the ribbon is exposed for use to impart ink onto a desired media. Feed rollers, drives, and gears, as well as a manually rotatable knob and other components, are located at various locations within the cassette to draw ribbon 202 into cassette 200 through opening 208 and fold ribbon 202 into opening 204. An exit gate 210, retaining walls 212, and bumps 214 are located at the side of space 204 and ahead of opening 206. Exit gate 210 extends between the top and bottom of cassette 200. Retaining walls 212 and bumps 214 extend from the floor of cassette 200 only a partial distance. A cover (not shown) typically covers space 204, where the cover would also have retaining walls and bumps extending slightly downward into space 204. Note that retaining walls 212 and bumps 214 are shown here mainly for perspective, and details of these structures will be described in more detail below.

Figure 3:
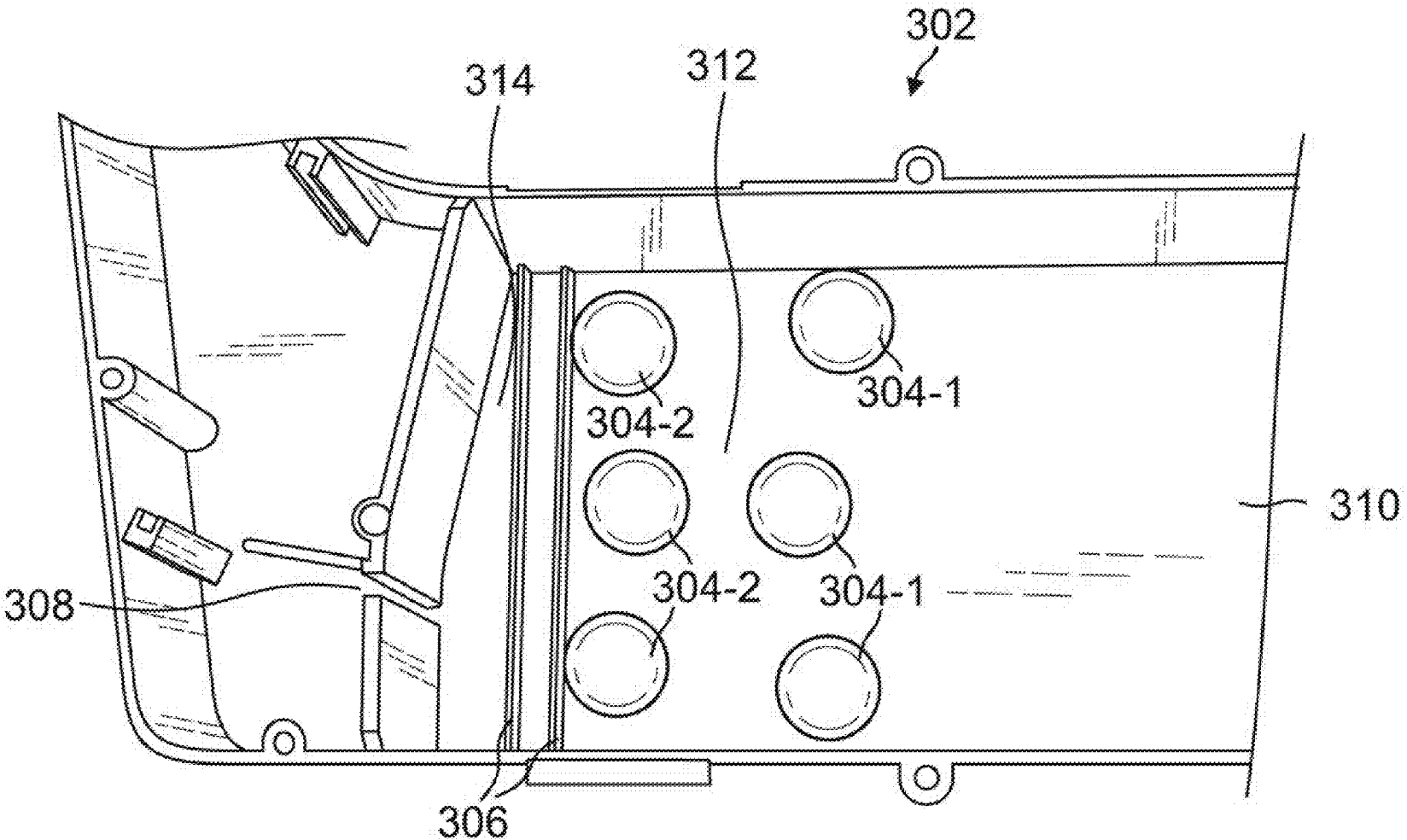
FIG. 3 shows a portion of the ribbon cartridge according to one embodiment.

FIG. 3 shows a portion 302 of ribbon cassette 200 according to one embodiment. Portion 302 is shown as a left corner of the cassette, although features of the present invention may also be in other portions. Portion 302 includes an arrangement of spherical bumps 304-1 and 304-2 and retaining walls 306 along the floor and ceiling (or inner surface of the cover). FIG. 3 only shows bumps 304-1 and 304-2 and retaining walls 306 on the floor of cassette 200. The cover and corresponding bumps and retaining walls are not shown for clarity. In this embodiment, a first row of bumps 304-1, a second row of bumps 304-2, and two retaining walls 306 are formed to create functionally distinct zones through which the ribbon web passes as it circulates through the cassette. In one embodiment, the bumps and retaining wall(s) on the ceiling or cover are aligned with bumps 304-1 and 304-2 and retaining walls 306 along the floor. In another embodiment, the bumps and retaining wall(s) are staggered from the placement of bumps 304-1 and 304-2 and retaining walls 306 on the floor.

Bumps 304-1 and 304-2 should be tall enough so that even after the ribbon width has shrunk (e.g., due to lengthwise stretching), the bumps will still somewhat impede the flow of the ribbon pack towards an exit gate 308. Since gravitational forces tend to keep the ribbon against the floor of the cassette housing, as the ribbon shrinks (in width), the distance between the top edge of the ribbon and the inside surface of the cassette cover (the ceiling of the stuff box) increases. Consequently, the bumps on ceiling or surface of the cover are made taller than the bumps on the floor. In one embodiment, the bumps on the floor are approximately 0.110" tall, and the bumps on the ceiling are approximately 0.125" tall.

The distance between bumps varies depending upon whether the bumps are in the first or second row, and whether the walls are arched or straight. In the arched-rib or wall arrangement, the bumps in the outer ring (between first and second zones, discussed below), in one embodiment, are roughly one inch apart, while the bumps in the inner ring (between the second and third) are approximately 0.8 inches apart. The sphere radii may be 0.362 inches on the floor of the cassette housing and 0.342 inches on the ceiling of the cover. In one embodiment, the diameter of these bumps where they intersect the floor and ceiling are all 0.520 inches diameter, and in the cassette housing, the bumps stand 0.11 inches high above the floor, whereas in the cover, they stand 0.120 inches above the ceiling surface. The clearance between the bumps in the floor and those in the ceiling is 0.965 inches in one embodiment, with a ribbon width of 1.145 inches.

The exact number and placement of the bumps will depend upon various factors, including the geometry of the ribbon stuff-box area, the geometry of the cassette walls in the vicinity of the exit gate, and the geometry of the retaining wall or walls.

In this embodiment, with two rows of bumps 304-1 and 304-2, three distinct zones are formed in the ribbon cassette, namely, a high high-density packing first zone 310, a low-density un-packing second zone 312, and a web isolation third zone 314. First zone 310 is bounded by the machine components used to stuff the ribbon into the box at one end (e.g., the drive and idler gears), the two side walls of the cassette, and the first row of bumps 304-1 arrayed in a slightly concave arch. Second zone 312 is bounded by the first row of bumps 304-1, the two sidewalls, and the second row of bumps 304-2 arrayed in a slightly convex arch with respect to the approaching ribbon. The two-dimensional area of second zone 312 (in the configuration with straight bumps) is approximately 2.5 sq. inches in one embodiment. Third zone 314 is bounded by the second row of bumps 304-2, the two sidewalls, and exit gate 308 and its adjacent wall surfaces. Third zone 314 also includes two shallow retaining walls 306 aligned perpendicular to the general flow of the ribbon. Note that in other embodiments, only one retaining wall is present on the floor and ceiling of the cassette. In one embodiment, the height of the two walls (inside third zone 314) is 0.092" in the housing, and the rib in the cover closest to the gate is 0.145 inches tall, while the one furthest from the gate is 0.125 inches tall. The walls, in one embodiment, are 0.25 inches apart in both the housing and cover, with the wall closest to the gate 0.38 inches distant from the gate. In one embodiment, the area of third zone 314 is approximately 2.28 sq. inches.

With straight retaining walls 306, the extreme ends of the walls end up being places where ribbon tends to bind, e.g., at the far upper or interior end of the walls, where the exiting ribbon pinches against the walls at the greatest wrap angle around the gate wall. This pinching or jamming can also occur at the end of the retaining walls as well. Moving the spherical bumps in these locations further away from exit gate 308, but keeping them close to the side walls produces the concave shape. Thus, the wrap angle at exit gate 308 is reduced and the tightly packed ribbon bundles in these locations collapsed towards the middle of the cassette when their turn came to unpack.

Figure 4:
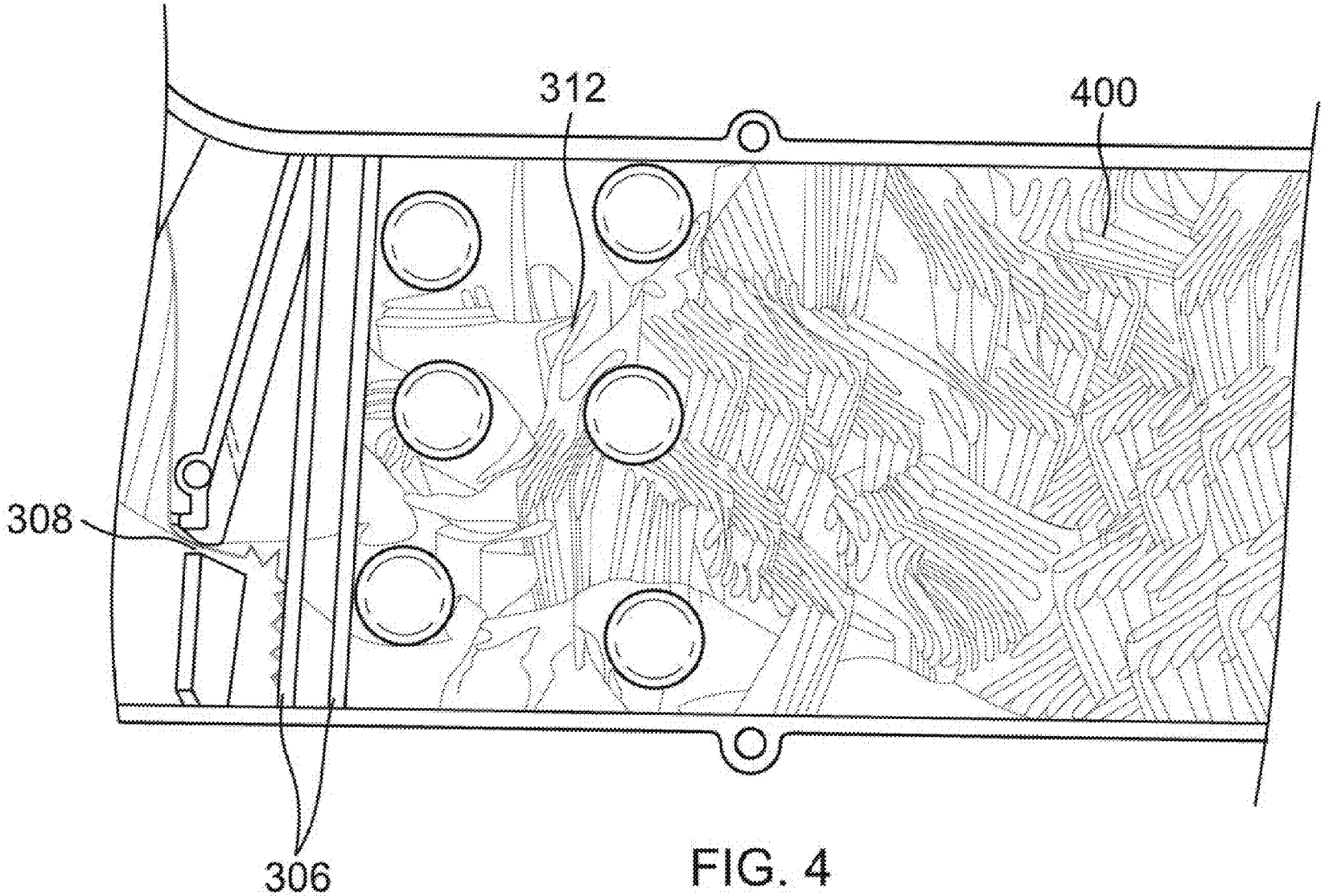
FIG. 4 shows a portion of the ribbon cartridge with ribbon stuffed into a first zone, according to the embodiment of FIG. 3.

FIG. 4 shows a ribbon 400 stuffed into first zone 310 of the cassette in FIG. 3. First zone 310 is the zone of the cassette that is continually stuffed with ribbon 400 by the ribbon drive motor and gear set. As discussed previously, it is often desirable to stuff this area (first zone 310) with as much ribbon as possible, for example, to increase the ink capacity of the cassette. When new ribbon is initially stuffed into the cassette, ribbon 400 retains relatively large radii at the folds. This is because the ribbon has not yet been deformed by repeated hammering. One effect of these radii is that the density of the pack is more uniformly distributed, and there are not yet any tightly packed bundles of ribbon folds. As the ribbon undergoes deformation from printing forces and the aforementioned bundles form, the density of these bundles increases over time. In the absence of the spherical bumps, the dense bundles of ribbon will butt up against retaining walls 306, resulting in the upper and lower edges of ribbon being pinched together from the packing forces and contact with the retaining walls. When this happens, the tension in the exiting web can spike to a level beyond the capability of the drive motor to overcome, in which case the ribbon will stall.

However, due to the presence of the spherical bumps, the ribbon edges press up against the low contact angle of the bump rather than the steeper and continuous edge of the retaining walls. At some point, as the packing forces increase, one or more bundles abutting one or more bumps is forced over the bump and rapidly expands into second zone 312. Simultaneously the compressive forces momentarily relax somewhat in the vicinity of the recently vacated bundle and shift to some other bundle abutting one of the other bumps, where the process eventually repeats.

Second zone 312 allows the ribbon bundles to expand prior to reaching retaining walls 306. Because the ribbon packing density is lower in second zone 312 (usually containing only one recently expanded bundle of ribbon) than in first zone 310, tension in the web occupying second zone 312 is nearly zero and contact (and therefore friction) between adjacent segments of ribbon is also nearly zero.

While this embodiment shows two rows of spherical bumps and three zones, another embodiment may have a single row of bumps and two zones for a simpler configuration. In such a configuration, a single row of bumps would form the barrier between the stuffing box and the retaining walls. The ribbon bundles would expand from the first zone into the space between the bumps and the retaining walls (the second zone), but the retaining walls would keep the unwanted folds of ribbon from entering the exit gate. More ribbon can be stuffed into the cartridge than could without the single row of bumps. However, the tradeoff for a simpler design is that ribbon capacity is reduced as compared with a three-zone design as described in FIG. 3. As more ribbon is added to the cassette, the pressure on the leading bundles of packed ribbon occasionally causes too much ribbon to enter the expansion area. Since the farthest boundary in this case is the straight edge of the retaining wall, many of the folded segments remain relatively stiff and energetic. In this condition, if the exiting web rubs against these stiffer and more energetic segments of ribbon, higher friction forces develop and these unwanted folds of ribbon can be dragged into the exit gate. But with the addition of the second row of bumps, virtually all folds and lengths of ribbon except the one exiting length of ribbon are kept back from the retaining walls, out of reach from the exiting web, and therefore cannot be dragged into the exit gate.

Since the events and mechanisms of ribbon jamming in the gate are random, and the propensity for jamming increases with stuffing density, there may be a volume (or length) of ribbon for which the simplified 2-zone configuration would be adequate for a given cassette geometry.

Third zone 314, as described above, includes one or more retaining walls 306. The retaining wall or walls causes the exiting web (across its width) to buckle. Since the buckled form in the web will only exist in the immediate vicinity of the retaining wall (the ribbon elasticity causes it to return quickly to its straightened form), in theory the adjacent folds of ribbon will not advance to exit gate 308. As described previously, the retaining wall will only retain the ribbon so long as the compressive forces do not accumulate to the point where they either directly force some folds over the walls or indirectly contribute to such action by increasing the frictional forces between such folds and the exiting web.

However, with the addition of the spherical bumps, nearly all of the folds upstream of the exiting web are kept away from retaining walls 306. As the ribbon exits through gate 308, the web farther upstream is drawn out of second zone 312 and past the nearest spherical bumps. If significant rubbing develops between the exiting web and any segments bearing against the bumps, the tension forces are kept low by virtue of the fact that the bumps cannot support excessive tension and will release the pinched folds into the area just upstream of retaining walls 306.

Figure 5:
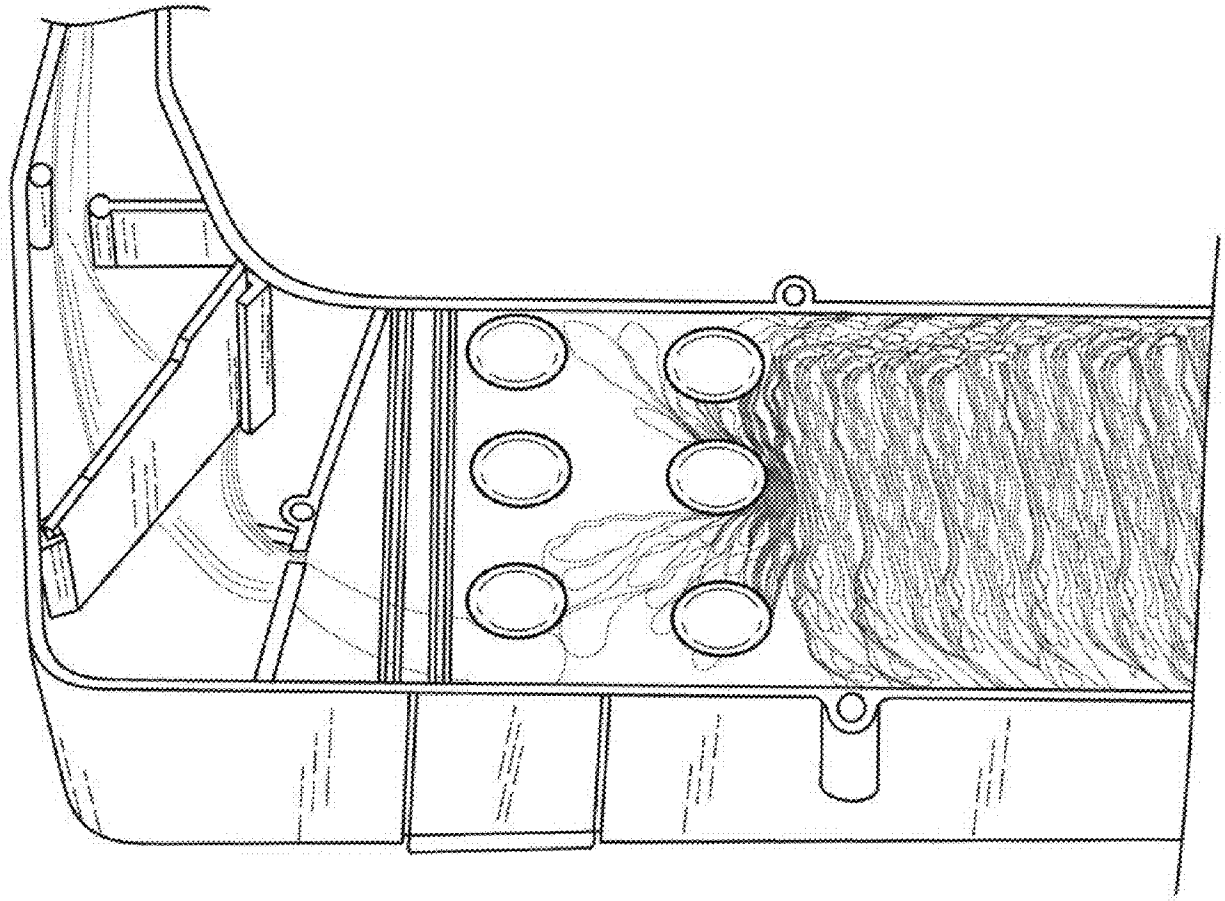
FIG. 5 shows a portion of the ribbon cartridge with ribbon in all three zones, according to the embodiment of FIG. 3.

FIG. 5 shows ribbon 400 passing through each of the three zones. After some printing has occurred, the morphology of the ribbon changes. One change is that the folds are now sharp, with the folded segments more tightly packed. As the ribbon is used more and more, the fold radii approach zero, i.e., the folded segments become tighter and tighter packed. Without spherical bumps, experiments have shown that some ribbon jams in the exit gate occur with 75 yards of ribbon stuffed into the cartridge. By adding a single row of bumps (three on the floor and three on the ceiling), ribbon volume was increased to 85 yards before some jamming occurred. By adding two rows of bumps (for a total of 12 bumps), the ribbon capacity of the cassette was increased to 105 yards without ribbon jamming occurring.

Figure 6:
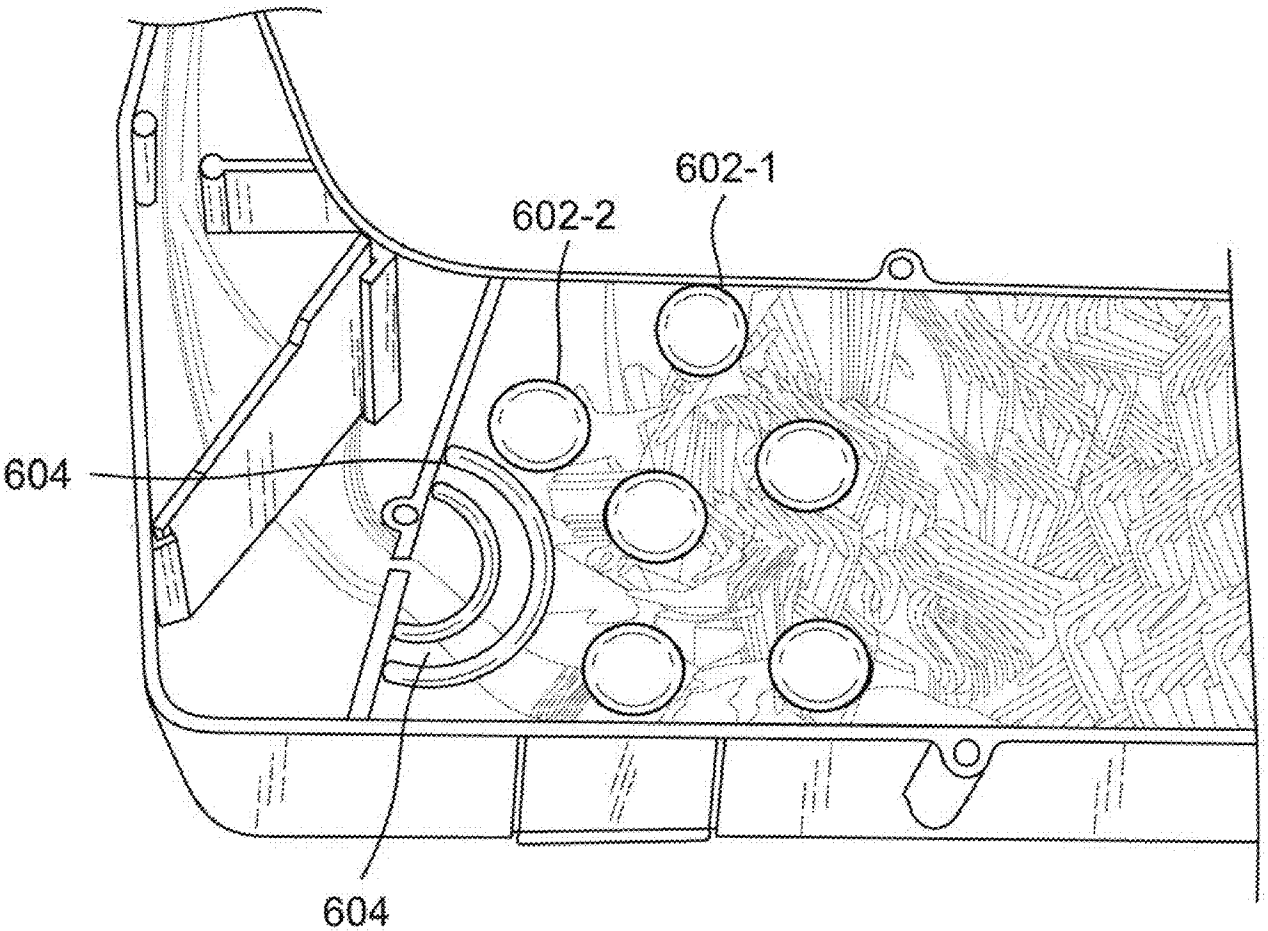
FIG. 6 shows a portion of the ribbon cartridge according to another embodiment, with ribbon in all three zones.

FIG. 6 shows a portion of a ribbon cassette according to another embodiment. In this embodiment, there are still two rows of three spherical bumps 602-1 and 602-2 and two retaining walls 604. However, the positioning of the spherical bumps and the shape of the retaining walls are both different from the embodiment of FIG. 3. In particular, the first row of spherical bumps 602-1 from more of a convex arch than a concave arch, the second row of spherical bumps 602-2 are moved closer to exit gate 308, and the shape of retaining walls 604 are concentric arches instead of straight lines. The size of the bumps can be the same as described in FIG. 3. In one embodiment, the height and cross-sectional shape of the arched walls is identical to the straight walls, where the inner edge of the inner arch (closest to the gate) is 0.37 inches and the radius of the inner edge of the outer wall (furthest from the gate) is 0.620 inches. Therefore the distance between them (measured from the same side of the walls) is 0.25 inches, which is the same as for the straight walls.

By forming the retaining walls as concentric arches centered on the exit gate, the spherical bumps 602-2 can be moved closer to exit gate 308, thereby increasing the available volume for the stuff box area. As a result, experiments have shown that the length of the ribbon can be increased to 120 yards without a ribbon jam. Even longer lengths of ribbon may be possible without jamming.

An arched retaining walls mitigates ribbon pinching. First, there is no longer a corner between the arched retaining walls and the sidewalls of the cassette, thus eliminating the increased frictional forces in these locations previously described. Also, when ribbon folds come in contact with the arched walls, they contact a curved surface rather than a straight surface. This effect tends to separate the folds from each other rather than pinch them together as happens with straight walls. Finally, using arched retaining walls increases the area of the second zone. The opening-up of the ends of the second zone allows for even less dense packing in these areas than is the case of a cassette with straight retaining walls. Therefore, the value of the concave formation of bumps in the first row is less necessary in this configuration. By not having this concave shape, the stuffing area, and thus the length of ribbon, can be increased.

The foregoing disclosure is not intended to limit the present disclosure to the precise forms or particular fields of use disclosed. As such, it is contemplated that various alternate embodiments and/or modifications to the present disclosure, whether explicitly described or implied herein, are possible in light of the disclosure. For example, the retaining walls may have shapes other than straight or curved, and the spherical bumps may be other shapes, such as oval, and have different numbers across different rows. Having thus described embodiments of the present disclosure, persons of ordinary skill in the art will recognize that changes may be made in form and detail without departing from the scope of the present disclosure. Thus, the present disclosure is limited only by the claims.

What is claimed is:

1. A ribbon cassette, comprising:

a container for holding a ribbon, wherein the container has a floor, sidewalls, a ceiling, and an exit gate;

a first plurality of bumps along a first row on the floor and curved away from the exit gate;

a second plurality of bumps along a first row on the ceiling and curved away from the exit gate;

a first retaining wall on the floor between the first plurality of bumps and the exit gate;

a second retaining wall on the ceiling between the second plurality of bumps and the exit gate;

a third plurality of bumps along a second row on the floor and curved toward the exit gate; and a fourth plurality of bumps along a second row on the ceiling and curved toward the exit gate, wherein the third and fourth plurality of bumps are between the first and second plurality of bumps and the first and second retaining walls.

2. The ribbon cassette of claim 1, wherein the first and second retaining walls are straight and span the sidewalls.

3. The ribbon cassette of claim 1, wherein the first and second plurality of bumps are spherically-shaped.

4. The ribbon cassette of claim 1, wherein the first and second plurality of bumps are aligned with each other.

5. The ribbon cassette of claim 1, further comprising:

a third retaining wall on the floor adjacent the first retaining wall; and a fourth retaining wall on the ceiling adjacent the second retaining wall.

6. The ribbon cassette of claim 1, wherein the first and second plurality of bumps and a first portion of the sidewalls form a high density packing zone, the first and second plurality of bumps, a second portion of the sidewalls, and the third and fourth plurality of bumps form a low density unpacking zone, and the third and fourth plurality of bumps, a third portion of the sidewalls, and the exit gate form a ribbon isolation zone.

7. The ribbon cassette of claim 1, wherein the first plurality is three and the second plurality is three.

8. The ribbon cassette of claim 1, wherein the first, second, third, and fourth pluralities are all three.

9. The ribbon cassette of claim 1, wherein the first and third plurality of bumps on the floor are shorter in height than the second and fourth plurality of bumps on the ceiling.

10. A ribbon cassette, comprising:

a ribbon container having sidewalls, a floor, a ceiling, and an exit gate;

a first row of spherical bumps on the floor extending between the sidewalls and curving toward the exit gate;

a second row of spherical bumps on the ceiling extending between the sidewalls and curving toward the exit gate;

a third row of spherical bumps on the floor between the first row and the exit gate extending between the sidewalls and curving toward the exit gate;

a fourth row of spherical bumps on the ceiling between the second row and the exit gate extending between the sidewalls and curving toward the exit gate;

a first pair of concentric arched retaining walls extending from the floor and curving toward the exit gate; and a second pair of concentric arched retaining walls extending from the ceiling and curving toward the exit gate, wherein the first and second pairs of retaining walls are between the exit gate and the third and fourth rows of spherical bumps.

11. The ribbon cassette of claim 10, wherein each row contains three spherical bumps.

12. The ribbon cassette of claim 10, wherein the first and third rows are aligned, the second and fourth rows are aligned, and the first and second pairs of retaining walls are aligned.

13. The ribbon cassette of claim 10, wherein the first and second row and a first portion of the sidewalls form a first zone for densely packing ribbon, the first and second row, a second portion of the sidewalls, and the third and fourth row form a second zone for unpacking the ribbon, and the third and fourth row, a third portion of the sidewalls, and the exit gate form a third zone for isolating the ribbon.

14. The ribbon cassette of claim 13, wherein the first zone is larger than the second and third zones.

15. The ribbon cassette of claim 10, wherein the spherical bumps on the floor are shorter in height than the spherical bumps on the ceiling.

* * * * *